US008290381B2

(12) United States Patent
Ishizuka et al.

(10) Patent No.: US 8,290,381 B2
(45) Date of Patent: Oct. 16, 2012

(54) IMAGE FORMING APPARATUS HAVING STABILIZING DEVICE

(75) Inventors: Tetsuo Ishizuka, Kanagawa (JP); Fumio Furusawa, Kanagawa (JP); Osamu Uto, Kanagawa (JP); Shiroh Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 566 days.

(21) Appl. No.: 12/546,161

(22) Filed: Aug. 24, 2009

(65) Prior Publication Data

US 2010/0189447 A1 Jul. 29, 2010

(30) Foreign Application Priority Data

Jan. 23, 2009 (JP) ..... 2009-013330

(51) Int. Cl.
*G03G 15/00* (2006.01)

(52) U.S. Cl. ..... 399/15

(58) Field of Classification Search ..... 399/15, 399/406, 341, 92
See application file for complete search history.

(56) References Cited

U.S. PATENT DOCUMENTS

| | | | | |
|---|---|---|---|---|
| 2005/0238399 | A1 | 10/2005 | Moteki | 399/406 |
| 2008/0253795 | A1 * | 10/2008 | Ishino | 399/92 |
| 2009/0317160 | A1 * | 12/2009 | Kougami | 399/406 |

FOREIGN PATENT DOCUMENTS

| | | |
|---|---|---|
| JP | 2000-310930 | 11/2000 |
| JP | 2005-335946 | 12/2005 |
| JP | 2006-91330 | 4/2006 |
| JP | 2006-308811 A | 11/2006 |
| JP | 2007-331870 | 12/2007 |

OTHER PUBLICATIONS

Machine translation of reference Sasaki et al. (JP 2006-091,330 A), Pub date Apr. 6, 2006.*

Japanese Office Action issued in corresponding Japanese Patent Application No. 2009-013330 mailed Jan. 10, 2012.

* cited by examiner

*Primary Examiner* — Walter L Lindsay, Jr.

*Assistant Examiner* — Rodney Bonnette

(74) *Attorney, Agent, or Firm* — Morgan, Lewis & Bockius LLP

(57) ABSTRACT

An image forming apparatus includes: an image forming unit that forms an image on a recording medium; a heating device that heats the image formed at the image forming unit, on the recording medium while recording medium is conveyed; a detecting device that is provided on a downstream side of the heating device in a recording medium conveying direction and detects image density and an image defect of the recording medium; and a stabilizing device that is provided between the detecting device and the heating device and stabilizes physical changes in the recording medium.

4 Claims, 12 Drawing Sheets

IMAGE FORMING APPARATUS HAVING STABILIZING DEVICE

CROSS-REFERENCE TO RELATED APPLICATION

This application is based on and claims priority under 35 USC 119 from Japanese Patent Application No. 2009-013330 filed on Jan. 23, 2009.

BACKGROUND

Technical Field

The present invention relates to an image forming apparatus.

SUMMARY

One aspect of the invention is an image forming apparatus comprising: an image forming unit that forms an image on a recording medium; a heating device that heats the image formed at the image forming unit, on the recording medium while recording medium is conveyed; a detecting device that is provided on a downstream side of the heating device in a recording medium conveying direction and detects image density and an image defect of the recording medium; and a stabilizing device that is provided between the detecting device and the heating device and stabilizes physical changes in the recording medium.

BRIEF DESCRIPTION OF THE DRAWINGS

Exemplary embodiments of the present invention will be described in detail based on the following figures, wherein:

FIG. 3A illustrates a perspective view of a vacuum conveying device and FIG. 3B illustrates a side view of the vacuum conveying device;

DETAILED DESCRIPTION

An image forming apparatus according to an exemplary embodiment of the present invention will be described below with reference to FIGS. 1 to 12.

(Entire Configuration)

Figure 1:
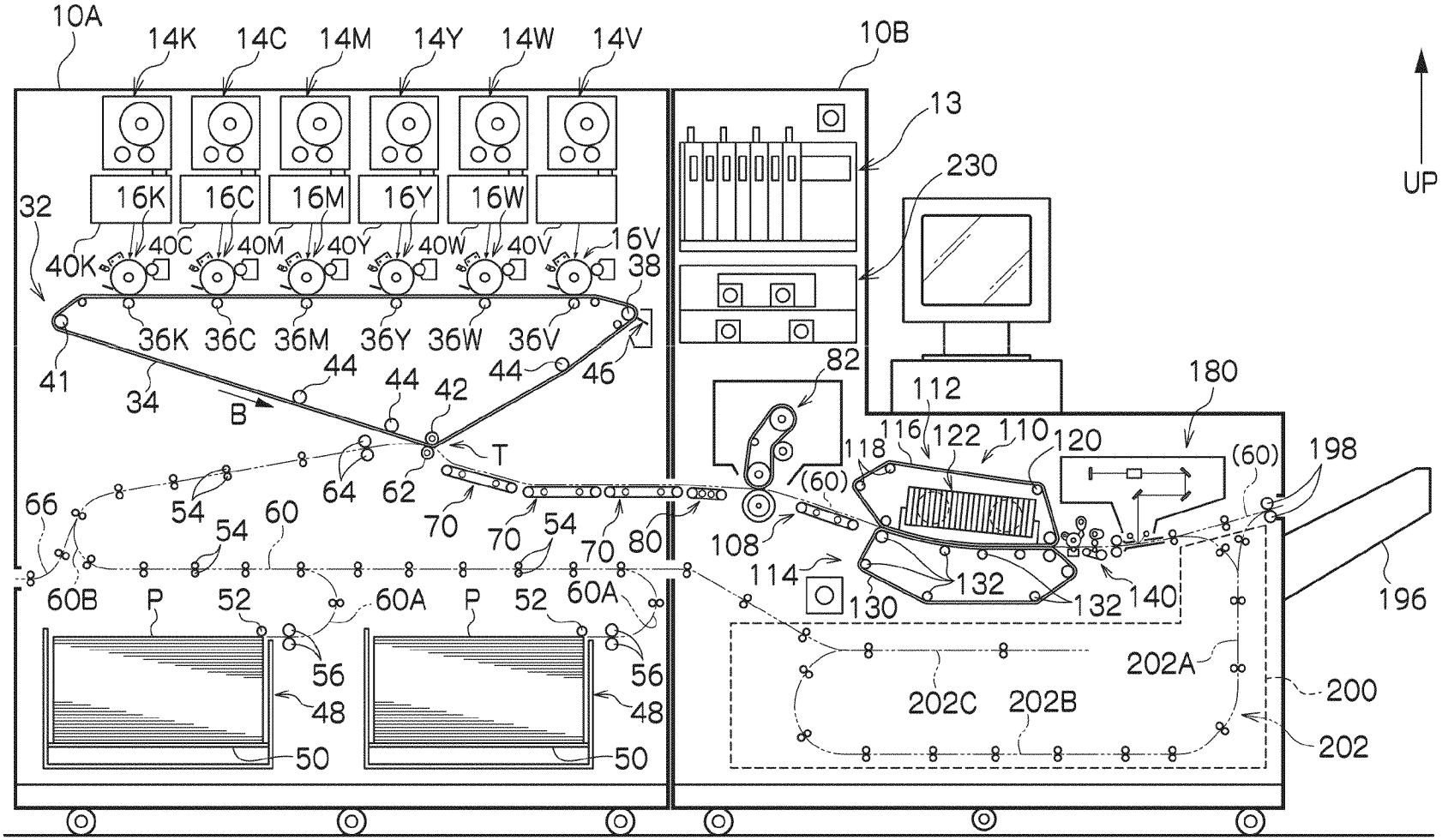
FIG. 1 is a schematic diagram illustrating an entire configuration of an image forming apparatus according to an exemplary embodiment of the present invention.

As illustrated in FIG. 1, an image forming apparatus 10 is one that forms a full-color image or a monochrome image. The image forming apparatus 10 may be divided into a first chassis 10A and a second chassis 10B, the first chassis 10A is disposed on one side (left of FIG. 1) in a horizontal direction, and the second chassis 10B is disposed on the other side (right of FIG. 1) in the horizontal direction.

An image signal processing section 13 is provided in an upper part of the second chassis 10B, and the image signal processing section 13 performs image processing to image data transmitted from a personal computer and the like.

(Toner Cartridge)

On the other hand, in an upper part of the first chassis 10A, toner cartridges 14V, 14W, 14Y, 14M, 14C, and 14K are horizontally arranged in a replaceable manner. First special color (V) toner, second special color (W) toner, yellow (Y) toner, magenta (M) toner, cyan (C) toner, and black (K) toner are respectively stored in the toner cartridges 14V, 14W, 14Y, 14M, 14C, and 14K.

Special colors (including transparent color) except for the yellow, magenta, cyan, and black colors are appropriately selected as the first special color and the second special color. In the following description, members corresponding to the V, W, Y, M, C, and K colors are distinguished from one another by adding suffixes V, W, Y, M, C, and K, and the suffixes V, W, Y, M, C, and K are omitted when the members are not distinguished from one another.

Six image forming units 16 corresponding to V, W, Y, M, C, and K colors are horizontally arranged bellow the toner cartridges 14 so as to face the toner cartridges 14, and exposure units 40 are provided between each of the toner cartridges 14 and each of the image forming units 16.

(Exposure Unit)

The exposure unit 40 provided every image forming unit 16 receives the image data to which the image signal processing section 13 performs the image processing, modulates a semiconductor laser (not illustrated) according to color gradation data, and the semiconductor laser emit exposure light L according to the color gradation data.

More particularly, a surface of a photoreceptor 18 (see FIG. 2) is irradiated with the exposure light L (LV, LW, LY, LM, LC, and LK) to form an electrostatic latent image on the photoreceptor 18.

As can be seen from FIG. 1, the exposure unit 40 is adjacent to the image signal processing section 13 provided in the second chassis 10B such that wiring to connect the image signal processing section 13 with the exposure unit 40 is shortened.

(Image Forming Unit)

Figure 2:
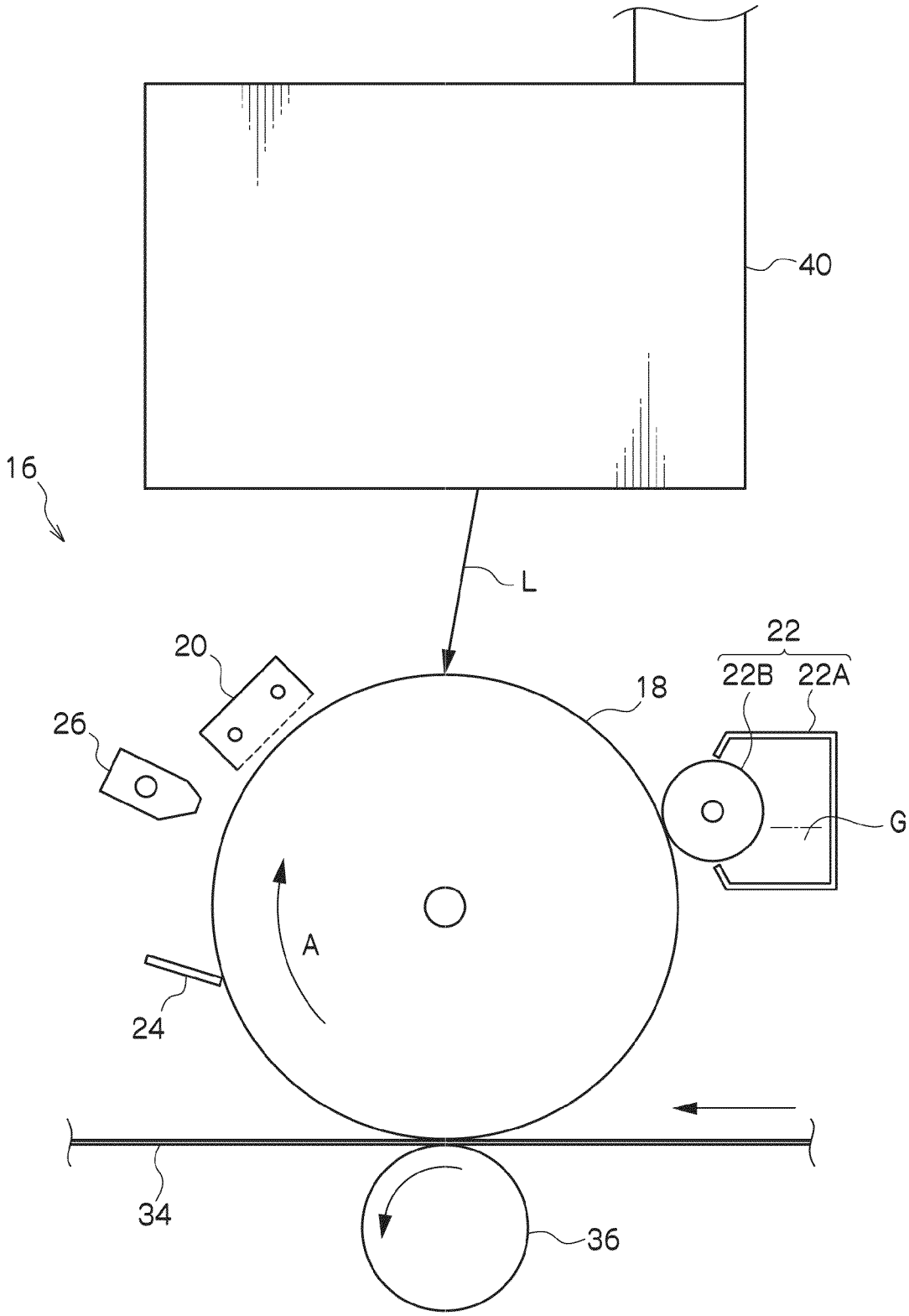
FIG. 2 is a side view illustrating an image forming unit used in the image forming apparatus of the exemplary embodiment of the present invention.

As illustrated in FIG. 2, the image forming unit 16 includes the photoreceptor 18 rotated in a direction (clockwise) of an arrow A. A corona discharge type (non-contact charging type) scorotron charger 20, a developing device 22, a cleaning blade 24, and an erase lamp 26 are provided around the photoreceptor 18. The scorotron charger 20 that is of an example of a charger evenly charges the photoreceptor 18. The developing device 22 develops the electrostatic latent image formed on the photoreceptor 18 with the exposure light L emitted from the exposure unit 40 using each color developer (toner). The cleaning blade 24 cleans the surface of the photoreceptor 18 after transfer. The erase lamp 26 that is of an example of an electricity removing device irradiates the surface of the photoreceptor 18 with light to remove the electricity after transfer.

The scorotron charger 20, the developing device 22, the cleaning blade 24, and the erase lamp 26 are disposed in this order from the upstream side toward the downstream side in the rotating direction of the photoreceptor 18 while facing the surface of the photoreceptor 18.

The developing device 22 includes a developer storage member 22A and a development roller 22B. The developer storage member 22A is disposed beside the photoreceptor 18 (right side in the exemplary embodiment), and filled with a developer G containing the toner. The development roller 22B moves the toner stored in the developer storage member 22A to the surface of the photoreceptor 18. The developer storage member 22A is communicated with the toner cartridge 14 (see FIG. 1) through a toner supply passage (not illustrated), and the toner is supplied from the toner cartridge 14 to the developer storage member 22A.

(Transfer Section)

As illustrated in FIG. 1, a transfer section 32 is provided below the image forming units 16. The transfer section 32 includes an endless intermediate transfer belt 34 and six primary transfer rollers 36. The intermediate transfer belt 34 is in contact with photosensitive bodies 18. The primary transfer rollers 36 that are of primary transfer members are provided inside the intermediate transfer belt 34, and the primary transfer rollers 36 multiply transfer the toner images formed on the photosensitive bodies 18 to the intermediate transfer belt 34.

The intermediate transfer belt 34 is entrained about a driving roller 38, a tension imparting roller 41, a backup roller 42, and plural suspension rollers 44 with a constant tension, and the intermediate transfer belt 34 is circularly driven in a direction (counterclockwise) of an arrow B of FIG. 1 by the driving roller 38. The driving roller 38 is driven by a motor (not illustrated). The tension imparting roller 41 adjusts the tension of the intermediate transfer belt 34. The backup roller 42 is disposed so as to face a secondary transfer roller 62 described later with the intermediate transfer belt 34 therebetween.

More particularly, the primary transfer rollers 36 are disposed so as to respectively face the photosensitive bodies 18 of the image forming units 16, with the intermediate transfer belt 34 therebetween. A power supply unit (not illustrated) applies a transfer bias voltage having a polarity opposite to a toner polarity to the primary transfer roller 36. Therefore, the toner images formed on the photosensitive bodies 18 are transferred to the intermediate transfer belt 34.

On the other hand, a cleaning blade 46 is provided at the opposite side of the driving roller 38 with the intermediate transfer belt 34 therebetween and a tip end of the cleaning blade 46 is in contact with the intermediate transfer belt 34. The cleaning blade 46 removes the residual toner or sheet dust on the circularly-moved intermediate transfer belt 34.

(Sheet Feeding Cassette)

Two large sheet feeding cassettes 48 are provided in parallel below the transfer section 32 in the first chassis 10A. The sheet members P that are of recording mediums are stored in the sheet feeding cassettes 48. That is, a large number of sheet members P may be stored in the sheet feeding cassettes 48. Because the sheet feeding cassettes 48 have the same configuration, only one of the sheet feeding cassettes 48 will be described and the other will not be described.

The sheet feeding cassette 48 is freely drawn from the first chassis 10A. The bottom plate 50 is provided in the sheet feeding cassette 48, and the sheet members P are stacked on the bottom plate 50. When the sheet feeding cassette 48 is drawn from the first chassis 10A, the bottom plate 50 is lowered by an instruction of a controller (not illustrated). When the bottom plate 50 is lowered, a user can supply the sheet members P to the sheet feeding cassette 48.

On the other hand, when the sheet feeding cassette 48 is attached to the first chassis 10A, the bottom plate 50 is lifted by the instruction of the controller. A delivery roller 52 is provided on one end side of the sheet feeding cassette 48 in order to deliver the sheet member P from the sheet feeding cassette 48 to a conveying path 60. The delivery roller 52 abuts on the uppermost sheet member P stacked on the lifted bottom plate 50.

(Conveying Path)

A separation roller 56 is provided on the downstream side (hereinafter simply referred to as "downstream side") of the delivery roller 52 in a sheet member conveying direction in order to prevent multi feeding of the sheet member P. Plural conveying rollers 54 are provided on the downstream side of the separation roller 56 in order to convey the sheet member P to the downstream side in the conveying direction.

In the conveying path 60 provided between the sheet feeding cassette 48 and the transfer section 32, the sheet member P delivered from the sheet feeding cassette 48 is turned back to the opposite side at a first fold-back part 60A, and the sheet member P is turned back to the opposite side at a second fold-back part 60B, whereby the sheet member P is advanced toward a transfer point T where the sheet member P is sandwiched between the secondary transfer roller 62 and the backup roller 42.

An aligner (not illustrated) is provided between the second fold-back part 60B and the transfer point T in order to correct an inclination of the conveyed sheet member P, and an alignment roller 64 is provided between the aligner and the transfer point T in order to match the timing at which the toner image on the intermediate transfer belt 34 is moved with the timing at which the sheet member P is conveyed.

A power supply unit (not illustrated) applies a transfer bias voltage having a polarity opposite to the toner polarity to the secondary transfer roller 62. Therefore, the toner images multiply transferred on the intermediate transfer belt 34 are secondary-transferred to the sheet member P conveyed along the conveying path 60 by the secondary transfer roller 62.

An auxiliary path 66 extended from a side surface of the first chassis 10A is provided so as to converge with the second fold-back part 60A of the conveying path 60. The sheet member P delivered from an external large-capacity tray disposed adjacent to the first chassis 10A enters the conveying path 60 through the auxiliary path 66.

(Vacuum Conveying Device)

On the downstream side of the transfer point T, plural vacuum conveying devices 70 are provided in order to convey the sheet member P onto which the toner image is transferred toward the second chassis 10B.

Figure 3A:
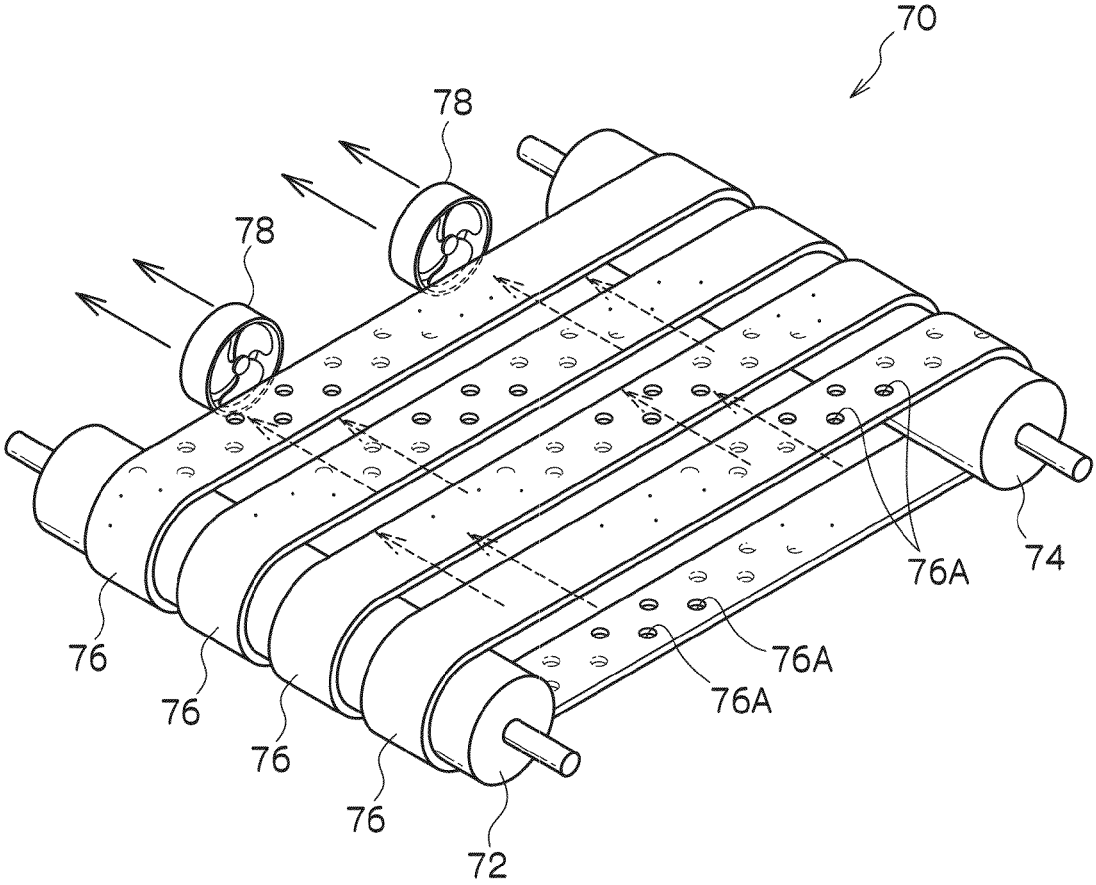
FIGS. 3A and 3B indicate a vacuum conveying device used in the image forming apparatus of the exemplary embodiment of the present invention.
Figure 3B:
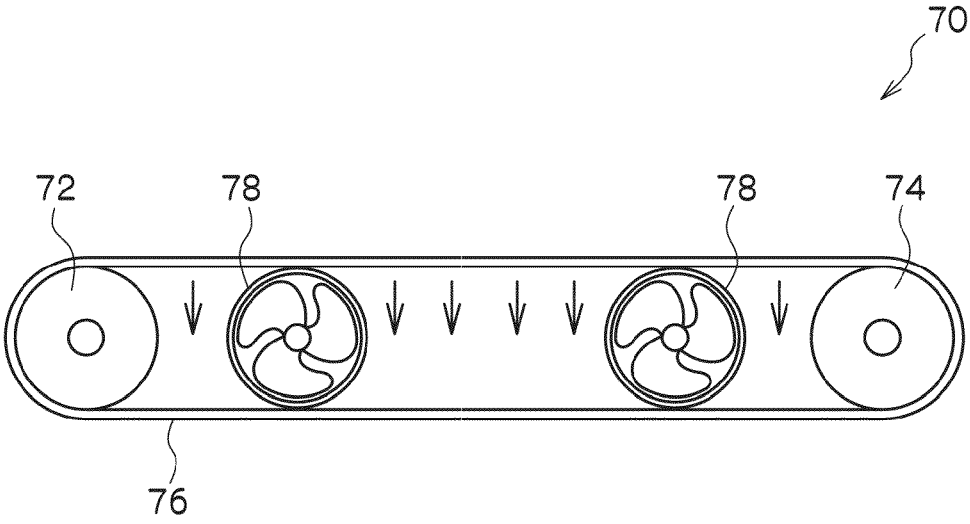

As illustrated in FIGS. 3A and 3B, the vacuum conveying device 70 includes a driving roller 72 rotary driven, a driven roller 74 rotatably supported, and plural belt members 76 entrained about the driving roller 72 and driven roller 74.

Plural throughholes 76A are formed over the entire surface of the belt member 76. Sucking fans 78 are disposed on the backside of the first chassis 10A (back side of FIG. 1) so as to suck air from the throughhole 76A into the inside of the belt member 76.

Therefore, in the sheet member P, a non-image surface in which the toner image is not formed is sucked to the belt member 76, and the driving roller 72 is rotated so as to rotate the belt member 76, thereby conveying the sheet member P toward the downstream side.

The three vacuum conveying devices 70 are provided on the downstream side of the conveying path 60, and downstream side of the conveying path 60 is extended from the first chassis 10A to the second chassis 10B. The sheet member P delivered by the vacuum conveying device 70 is received by a vacuum conveying device 80 provided in the second chassis 10B, and the sheet member P is further conveyed to the downstream side.

The downstream side of the vacuum conveying device 80 is disposed in the second chassis 10B, and a fixing unit 82 is provided on the downstream side of the vacuum conveying device 80 in order to fix the toner image, which is transferred on the surface of the sheet member P, onto the sheet member P by heat and pressure.

(Fixing Unit)

Figure 4:
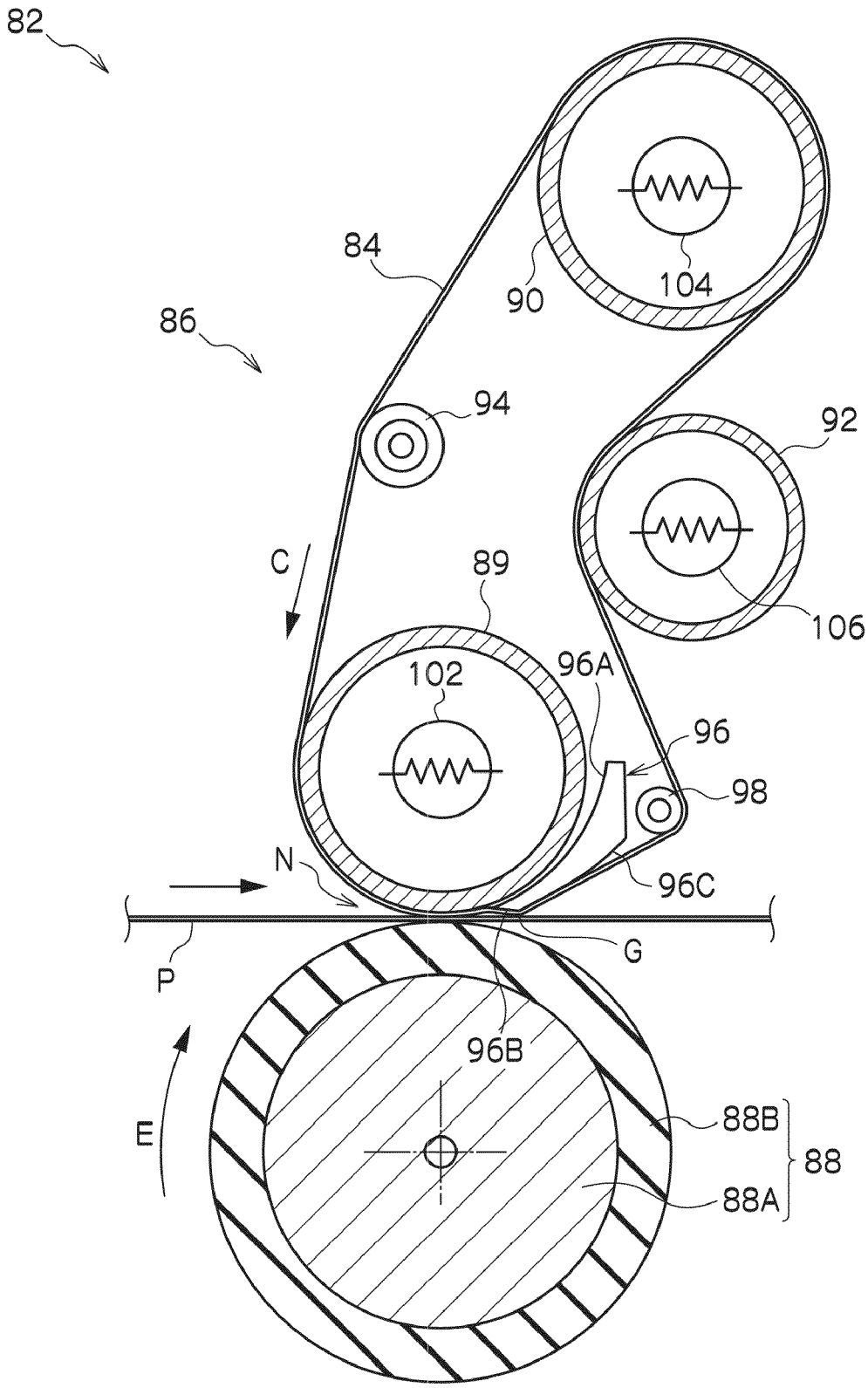
FIG. 4 is a side view illustrating a fixing unit used in the image forming apparatus of the exemplary embodiment of the present invention.

As illustrated in FIG. 4, the fixing unit 82 includes a fixing belt module 86 and a pressure roller 88. The fixing belt module 86 includes a fixing belt 84, and the pressure roller 88 is disposed in the fixing belt module 86 while being in press contact with the fixing belt module 86. A nip part N is formed between the fixing belt module 86 and the pressure roller 88. In the nip part N, the sheet member P is pressurized and heated to fix the toner image onto the sheet member P.

The fixing belt module 86 includes a fixing belt 84, a heating roller 89, and a stretching roller 90. The heating roller 89 is rotary driven by a torque of a motor (not illustrated) while stretching the fixing belt 84. The stretching roller 90 stretches the fixing belt 84 from the inside. The fixing belt module 86 also includes a stretching roller 92 and a posture correcting roller 94. The stretching roller 92 is disposed outside the fixing belt 84 to define a circulating path of the fixing belt 84. The posture correcting roller 94 located between the heating roller 89 and the stretching roller 90 to correct a posture of the fixing belt 84.

The fixing belt module 86 also includes a peeling pad 96 and a stretching roller 98. The peeling pad 96 is disposed in a downstream-side region in the nip part N, in which the fixing belt module 86 and the pressure roller 88 are in press contact with each other, and near the heating roller 89. The stretching roller 98 stretches the fixing belt 84 on the downstream side of the nip part N.

The heating roller 89 is a hard roller in which a fluororesin coating having a thickness of 200 μm is formed on a cylindrical core roller made of aluminum in order to prevent metallic abrasion of the surface of the core roller. A halogen heater 102 is provided as a heating device in the heating roller 89.

The stretching roller 90 is a cylindrical roller made of aluminum. A halogen heater 104 is provided as a heating source inside the stretching roller 90, and the halogen heater 104 heats the fixing belt 84 from the inner surface side. A spring member (not illustrated) is provided in both end parts of the stretching roller 90 in order to outwardly press the fixing belt 84, and a tension of the fixing belt 84 is set to 15 kgf.

The stretching roller 92 is a cylindrical roller made of aluminum. A separation layer made of fluororesin is formed on the surface of the stretching roller 92, and the separation layer has the thickness of 20 μm. The separation layer prevents a tiny amount of toner or sheet dust from depositing on the stretching roller 92, which invades from an outer circumferential surface of the fixing belt 84.

A halogen heater 106 is provided as a heating source inside the stretching roller 92, and the halogen heater 106 heats the fixing belt 84 from the outer circumferential surface side. That is, in the exemplary embodiment, the fixing belt 84 is heated by the heating roller 89, the stretching roller 90, and the stretching roller 92.

The posture correcting roller 94 is a cylindrical roller made of aluminum. A belt edge position sensing mechanism (not illustrated) is disposed near the posture correcting roller 94 in order to detect an edge position of the fixing belt 84. An axis displacement mechanism is provided in the posture correcting roller 94 so as to control meandering of the fixing belt 84 (belt walk). The axis displacement mechanism displaces a contact position in the axial direction of the fixing belt 84 according to the detection result of the belt edge position sensing mechanism.

The peeling pad 96 is a block-like member made of a rigid material such as stainless steel (SUS) and resin, and has a length corresponding to the heating roller 89. A sectional shape of the peeling pad 96 is formed into a substantial arc shape. The peeling pad 96 includes an inner surface 96A, a pressing surface 96B, and an outer surface 96C. The inner surface 96A faces the heating roller 89. The pressing surface 96B presses the fixing belt 84 against the pressure roller 88. The outer surface 96C has a predetermined angle with respect to the pressing surface 96B to bend the fixing belt 84.

Particularly a corner portion G formed by the pressing surface 96B and the outer surface 96C bends the fixing belt 84 that is pressed against the corner portion G by the pressure roller 88, and the corner portion G peels the leading edge of the sheet member P from the fixing belt 84 when the leading edge of the sheet member P passes by the corner portion G.

On the other hand, the pressure roller 88 is a soft roller in which an elastic layer 88B and a peeling layer are laminated in the order on a base that is of a cylindrical roller 88A made of aluminum. The elastic layer 88B having the thickness of 10 mm is made of silicone rubber with rubber hardness 30° (JIS-A). The peeling layer is made of a PFA tube having a thickness of 100 μm. The pressure roller 88 is rotatably supported, and a biasing member such as a spring or the like (not illustrated) presses the pressure roller 88 against the fixing belt 84 at a region where the fixing belt 84 is entrained about the heating roller 89. Therefore, as the heating roller 89 of the fixing belt module 86 is rotary driven in a direction of an arrow C, the pressure roller 88 is driven by the heating roller 89 and rotated in a direction of an arrow E.

(Sheet Cooling Unit)

As illustrated in FIG. 1, a vacuum conveying device 108 is provided on the downstream side of the fixing unit 82 in order to convey the sheet member P delivered from the fixing unit 82 to the downstream side. A cooling unit 110 is provided on the downstream side of the vacuum conveying device 108 in order to cool the sheet member P heated by the fixing unit 82.

In the cooling unit 110, an absorbing device 112 that absorbs heat of the sheet member P is provided on one side (upper side in the exemplary embodiment) of the conveying path 60, and a press-down device 114 that presses down the conveyed sheet member P on the absorbing device 112 is provided on the other side (lower side in the exemplary embodiment).

An endless absorbing belt 116 is provided in the absorbing device 112. The absorbing belt 116 comes into contact with the sheet member P to absorb the heat of the sheet member P. Plural stretching rollers 118 that support the absorbing belt 116 and a driving roller 120 that transmits a driving force to the absorbing belt 116 are provided inside the absorbing belt 116.

A heat sink 122 is also provided inside the absorbing belt 116. The heat sink 122 is in surface contact with the absorbing belt 116 to radiate the heat absorbed by the absorbing belt 116.

Figure 5:
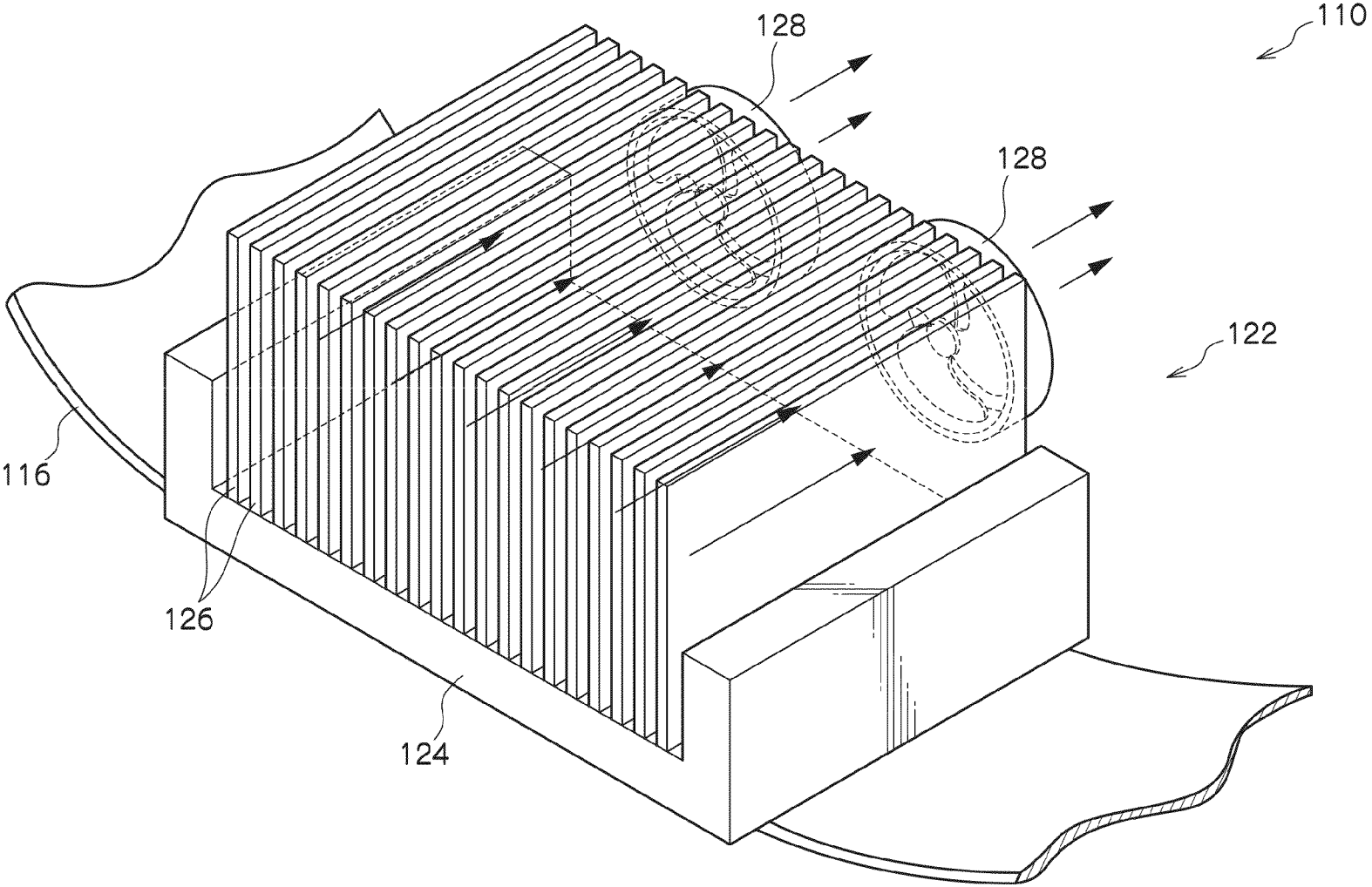
FIG. 5 is a perspective view illustrating a heat sink of a cooling unit used in the image forming apparatus of the exemplary embodiment of the present invention.

As illustrated in FIG. 5, the heat sink 122 includes a substantial U-shape abutment member 124 and plural radiator plates 126. An upper side of a region where the absorbing belt 116 abuts on the sheet member P is opened in the abutment member 124. The plural radiator plates 126 are mounted on the abutment member 124, and the heat is transmitted from the abutment member 124 to the plural radiator plates 126.

Sucking fans 128 are disposed on the back side of the second chassis 10B (back side of FIG. 1) such that the heat is drawn from the radiator plate 126 and hot air is exhausted to the outside.

On the other hand, as illustrated in FIG. 1, the press-down device 114 that presses down the conveyed sheet member P onto the absorbing device 112 includes an endless press-down belt 130 and plural stretching rollers 132. The press-down belt 130 comes into contact with the sheet member P to press down the sheet member P onto the absorbing device 112. The press-down belt 130 is entrained about, and rotatably supported by, the plural stretching rollers 132.

Therefore, the heat is drawn from the sheet member P to cool the sheet member P.

(Decurl Treatment Unit)

A decurl treatment unit 140 is provided on the downstream side of the cooling unit 110 in order to correct curl of the sheet member P.

Figure 6:
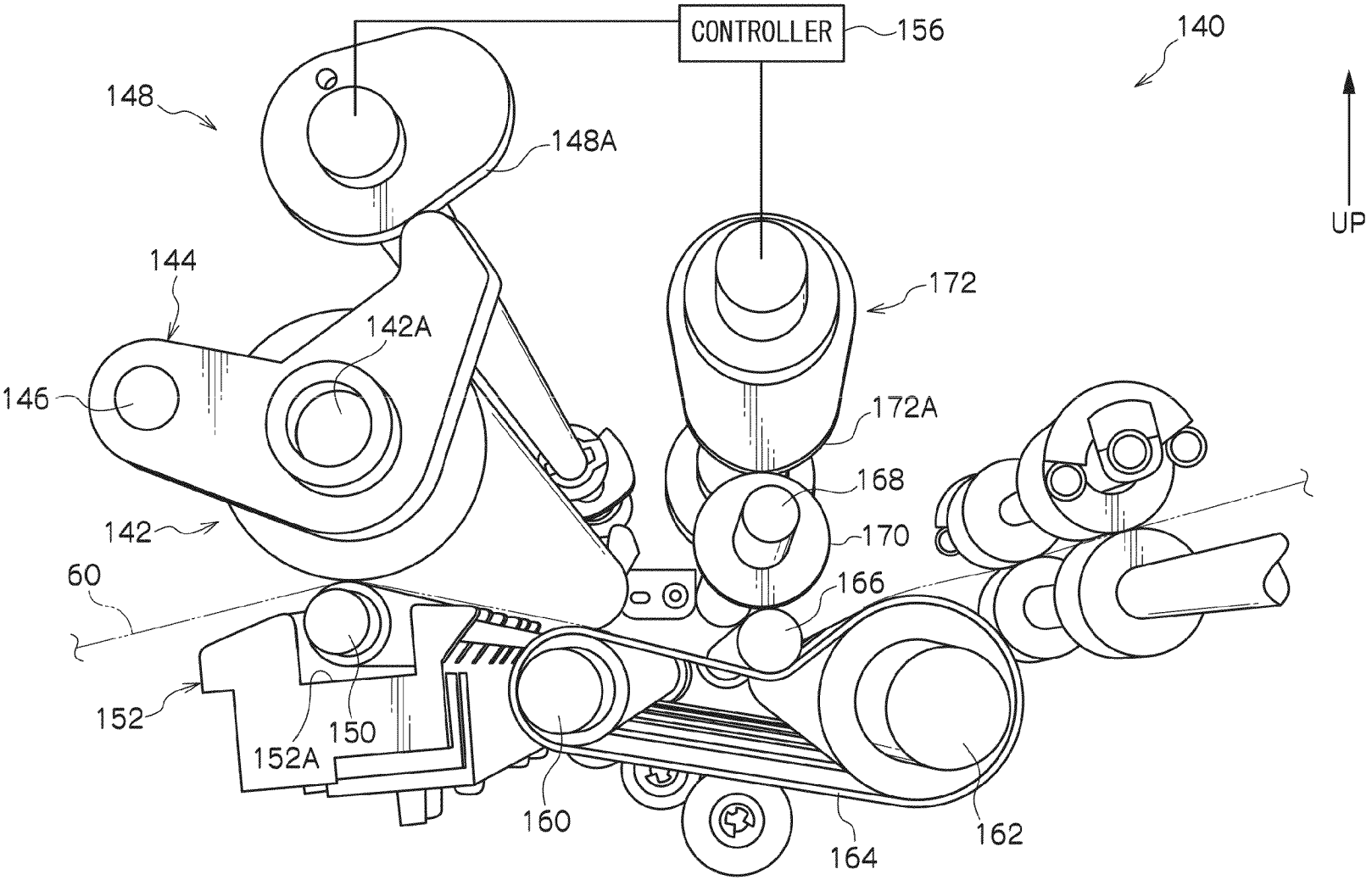
FIG. 6 is a configuration diagram illustrating a decurl treatment unit used in the image forming apparatus of the exemplary embodiment of the present invention.

As illustrated in FIG. 6, a guide member 152 that guides the sheet member P is provided on an upstream side of the decurl treatment unit 140 in the sheet member conveying direction upstream side (hereinafter simply referred to as "upstream side"). A recess 152A opened upward is formed in the guide member 152.

A conveying roller 150 that is rotatably axially supported at the apparatus main body is formed in the recess 152A. An elastic roller 142 is provided so as to face the conveying roller 150 with the conveying path 60 therebetween, and the elastic roller 142 is driven by the conveying roller 150. In the elastic roller 142, the surface thereof is made of an elastic material to enlarge a diameter of the elastic roller 142.

A rotating shaft 142A of the elastic roller 142 is rotatably supported by a central side of a plate-like bracket 144 whose central side is bent. One end side of the bracket 144 is rotatably supported by a shaft 146 of a frame member (not illustrated), and the other end abuts on a cam surface 148A of a cam member 148, thereby positioning the bracket 144.

That is, the elastic roller 142 abuts on the conveying roller 150 to deform the surface of the elastic roller 142, thereby generating a restoring force of the elastic roller 142. The other end of the bracket 144 is biased toward the cam surface 148A by the restoring force of the elastic roller 142 to determine the position of the bracket 144.

A controller 156 is provided to control a rotation angle of the cam member 148. The controller 156 rotates the cam member 148 to move the elastic roller 142 between a retracted position where the elastic roller 142 is lightly pressed against the conveying roller 150 (see FIGS. 6 and 7A) and a pressing position where the surface of the elastic roller 142 is elastically deformed to project the conveying path 60 by strongly pressing the elastic roller 142 against the conveying roller 150 (see FIGS. 8 and 9A).

Stretching rollers 160 and 162 are provided on the downstream side of the conveying roller 150 while horizontally separated from each other. Plural elastic belt members 164 whose upper surfaces constitute the conveying path 60 of the sheet member P are entrained about the stretching rollers 160 and 162.

A pressing roller 166 is rotatably provided at the opposite side of the conveying path 60 of the elastic belt members 164 with the conveying path 60 therebetween so as to press the elastic belt member 164. On a side of the pressing roller 166 opposite to the elastic belt members 164, there is provided a support roller 168, which is supported at both end parts thereof by the bracket 158 (see FIG. 7B) that is the same as that for the pressing roller 166. The bracket 158 that supports the pressing roller 166 and support roller 168 at both the end parts is supported by the apparatus main body while being movable in a direction in which the bracket 158 is brought close to or separated from the elastic belt member 164.

A circular pressing member 170 whose diameter is larger than that of the support roller 168 is provided in the rotatably-supported support roller 168, and an end face of the pressing member 170 abuts on a cam surface 172A of a cam member 172 provided above the support roller 168, thereby determining the position of the pressing member 170.

That is, the pressing roller 166 abuts on the elastic belt member 164 to deform the elastic belt member 164, thereby generating a restoring force of the elastic belt member 164. The pressing member 170 is biased toward the cam surface 172A by the restoring force of the elastic belt member 164 to determine the position of the pressing member 170.

Figure 7B:
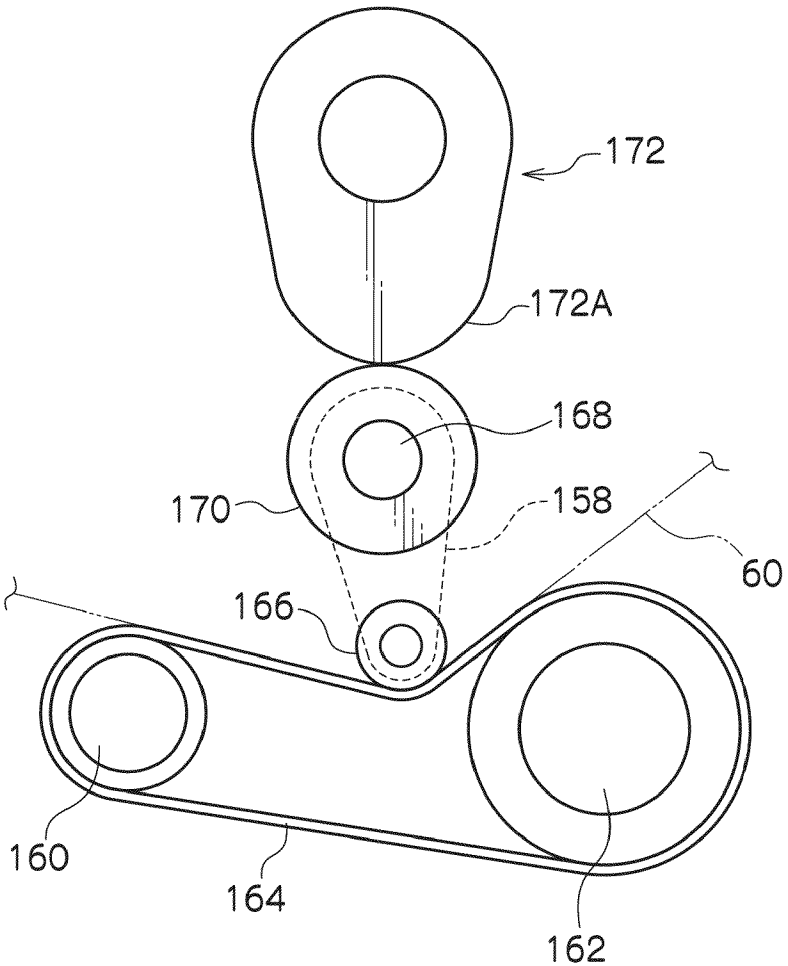
FIGS. 7A and 7B are side views illustrating a cam member of the decurl treatment unit used in the image forming apparatus of the exemplary embodiment of the present invention.
Figure 7A:
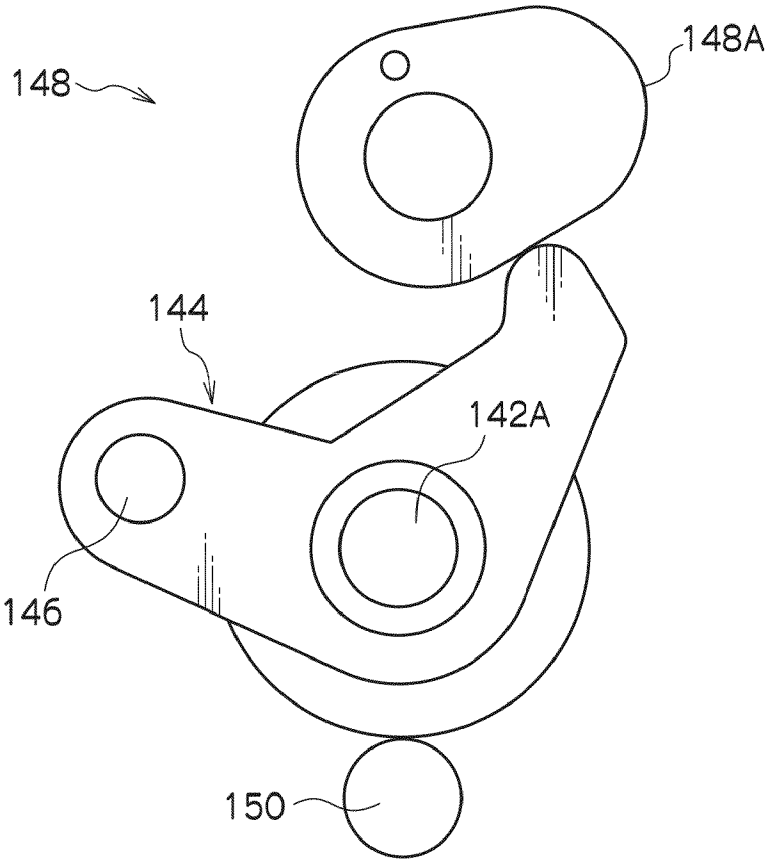
Figure 8:
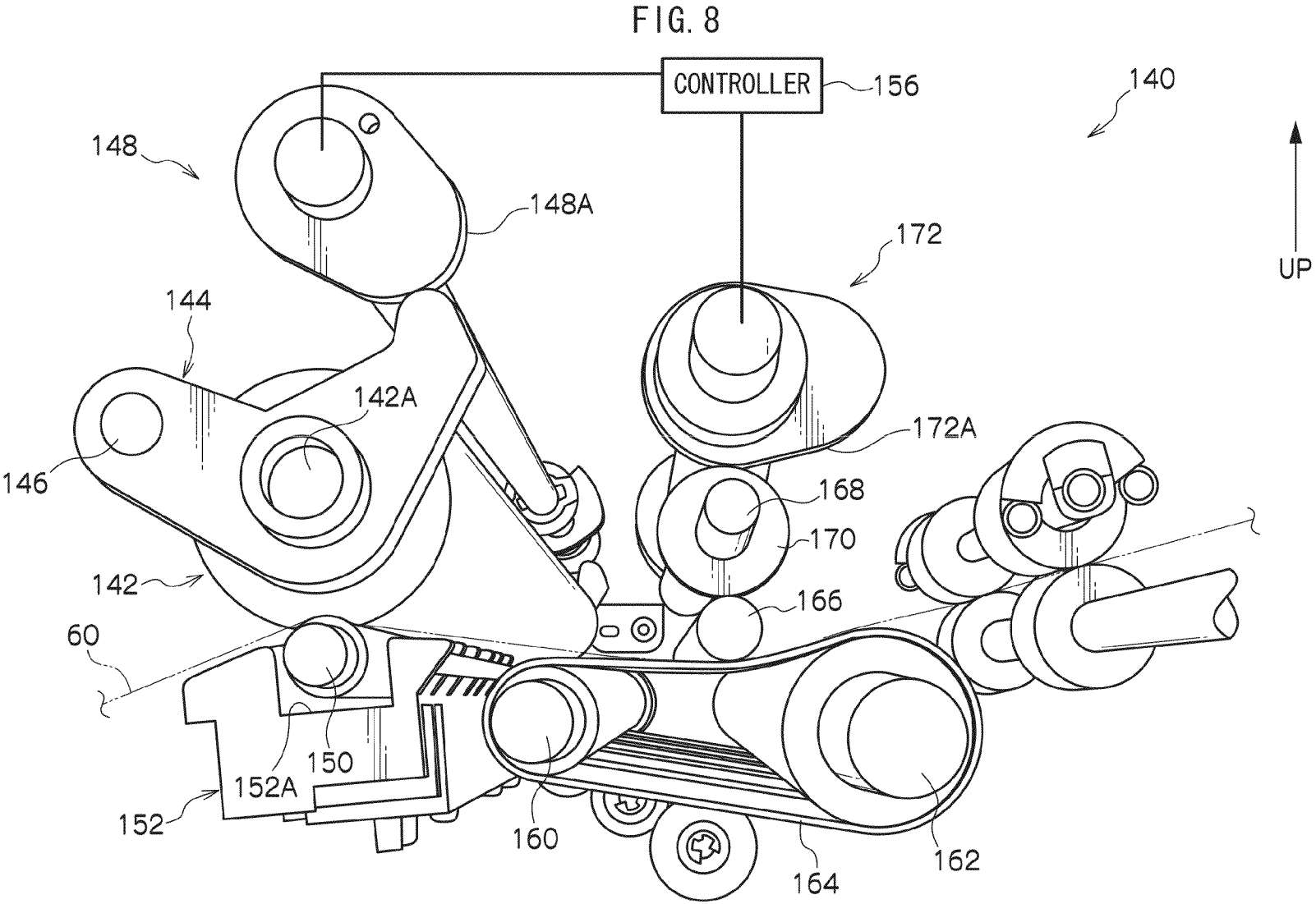
FIG. 8 is a configuration diagram illustrating the decurl treatment unit used in the image forming apparatus of the exemplary embodiment of the present invention.
Figure 9B:
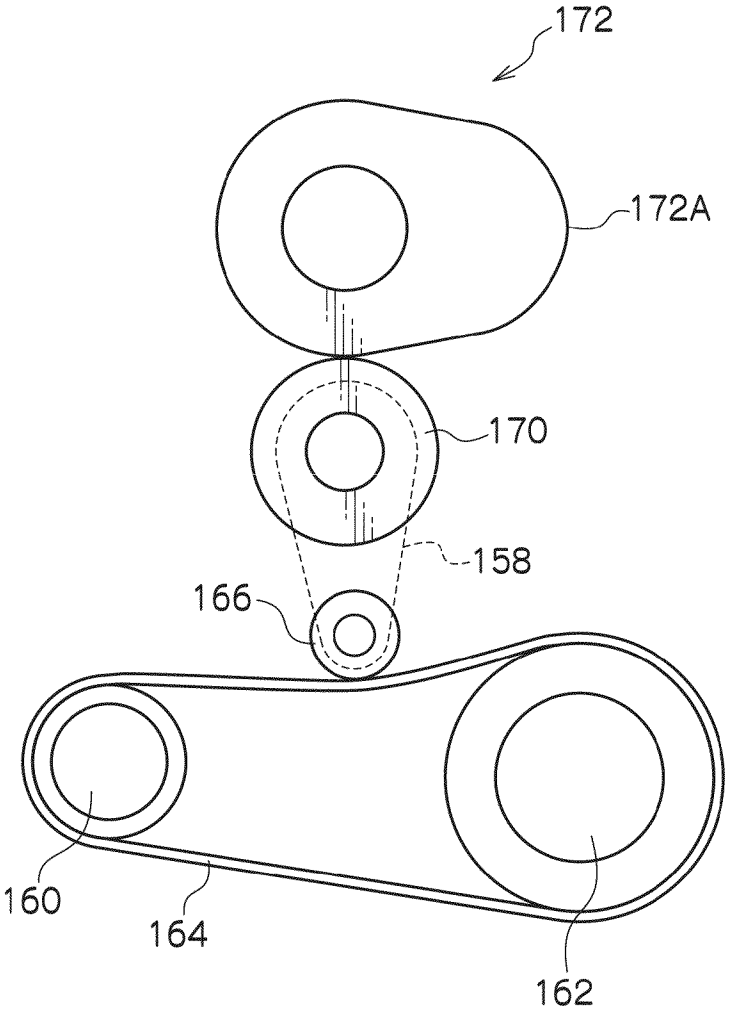
FIGS. 9A and 9B are side views illustrating the cam member and the like of the decurl treatment unit used in the image forming apparatus of the exemplary embodiment of the present invention.
Figure 9A:
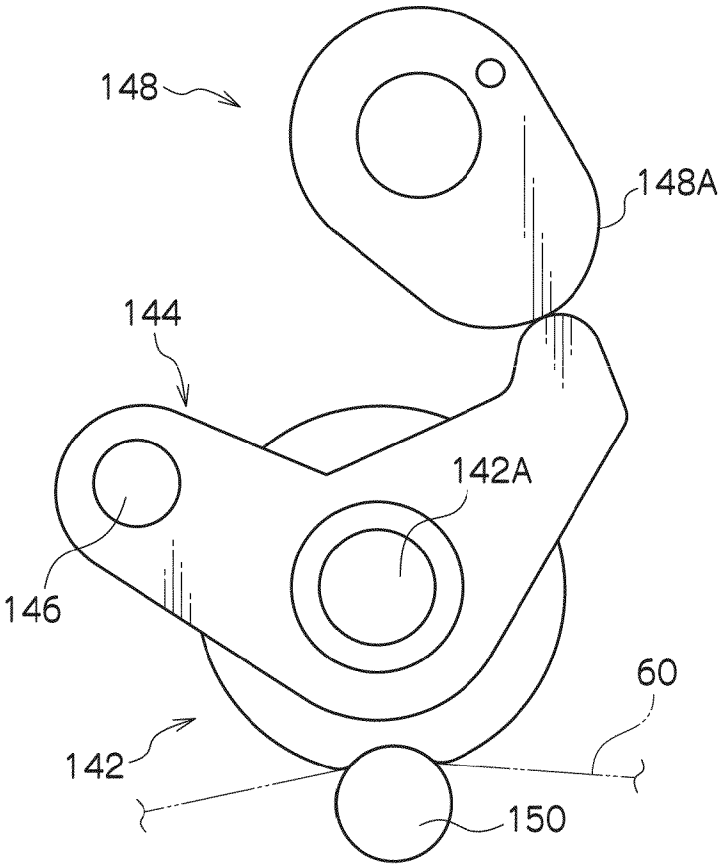

The controller 156 controls the rotation angle of the cam member 172 and rotates the cam member 172 to move the pressing roller 166 between the retracted position where the pressing roller 166 is lightly pressed against the elastic belt member 164 (see FIGS. 8 and 9B) and the pressing position where the surface of the elastic belt member 164 is elastically deformed to indent the conveying path 60 by strongly pressing the pressing roller 166 against the elastic belt member 164 (see FIGS. 6 and 7B).

Figure 10A:
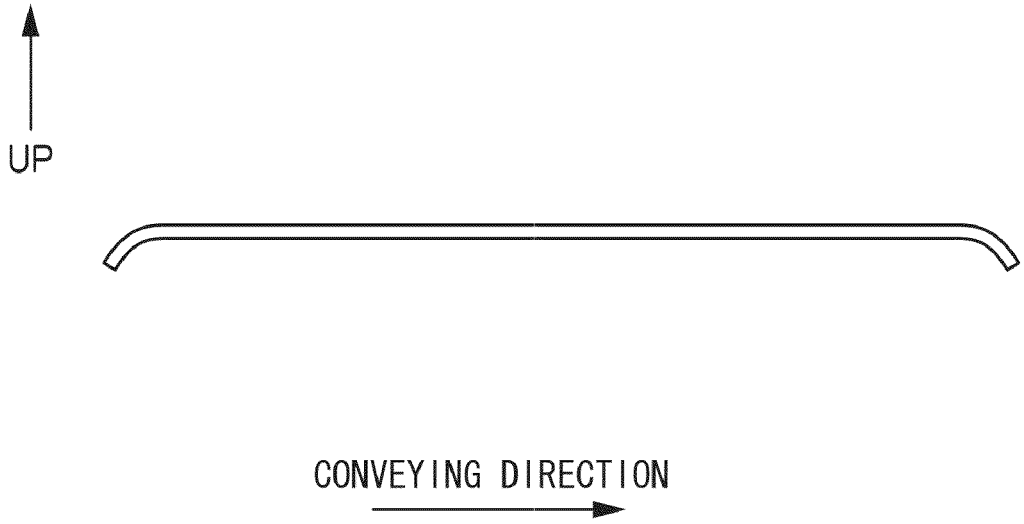
FIGS. 10A and 10B are side views illustrating curl of a sheet member corrected by the decurl treatment unit used in the image forming apparatus of the exemplary embodiment of the present invention.

Therefore, as illustrated in FIG. 10A, in cases where the end part of the conveyed sheet member P is curled downward, the controller 156 rotates the cam member 148 to move the elastic roller 142 to the retracted position (see FIGS. 6 and 7A), and rotates the cam member 172 to move the pressing roller 166 to the pressing position (see FIGS. 6 and 7B), thereby concavely deforming the conveying path 60. Therefore, downwardly-curled sheet member P is flatly corrected.

Figure 10B:
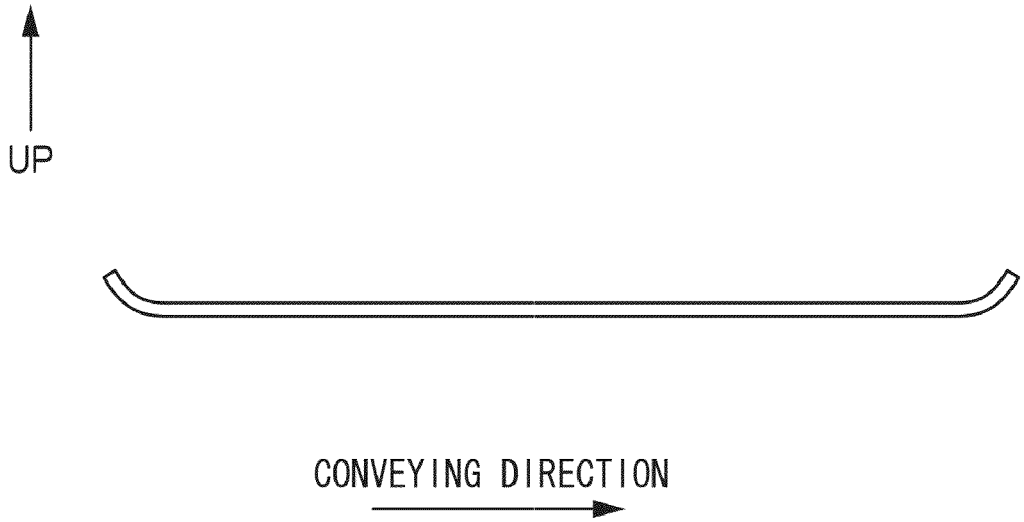

On the other hand, as illustrated in FIG. 10B, in cases where the end part of the conveyed sheet member P is curled upward, the controller 156 rotates the cam member 172 to move the pressing roller 166 to the retracted position (see FIGS. 8 and 9B), and rotates the cam member 148 to move the elastic roller 142 to the pressing position (see FIGS. 6 and 7B), thereby convexly deforming the conveying path 60. Therefore, upwardly-curled sheet member P is flatly corrected.

A curl direction and a degree of curl of the sheet member P depend on a type (plain paper or coated paper) of the sheet member P, a basic weight (grammage) of the sheet member P, a size, a delivery direction, image density (that may be predicted by image data information transmitted to the exposure unit), shape of the sheet running path dedicated to the machine, and characteristics of units disposed on the path. The controller 156 predicts the curl direction or the degree of curl from the pieces of information forementioned and may change the rotation angles of the cam members 148 and 172 to adjust the degree of concavity or convexity of the conveying path 60.

(In-line Sensor Unit)

As illustrated in FIG. 1, an in-line sensor unit 180 is provided on the downstream side of the decurl treatment unit 140 in order to detect a toner density defect, an image defect, and an image position defect of the toner image fixed to the sheet member P.

Figure 11:
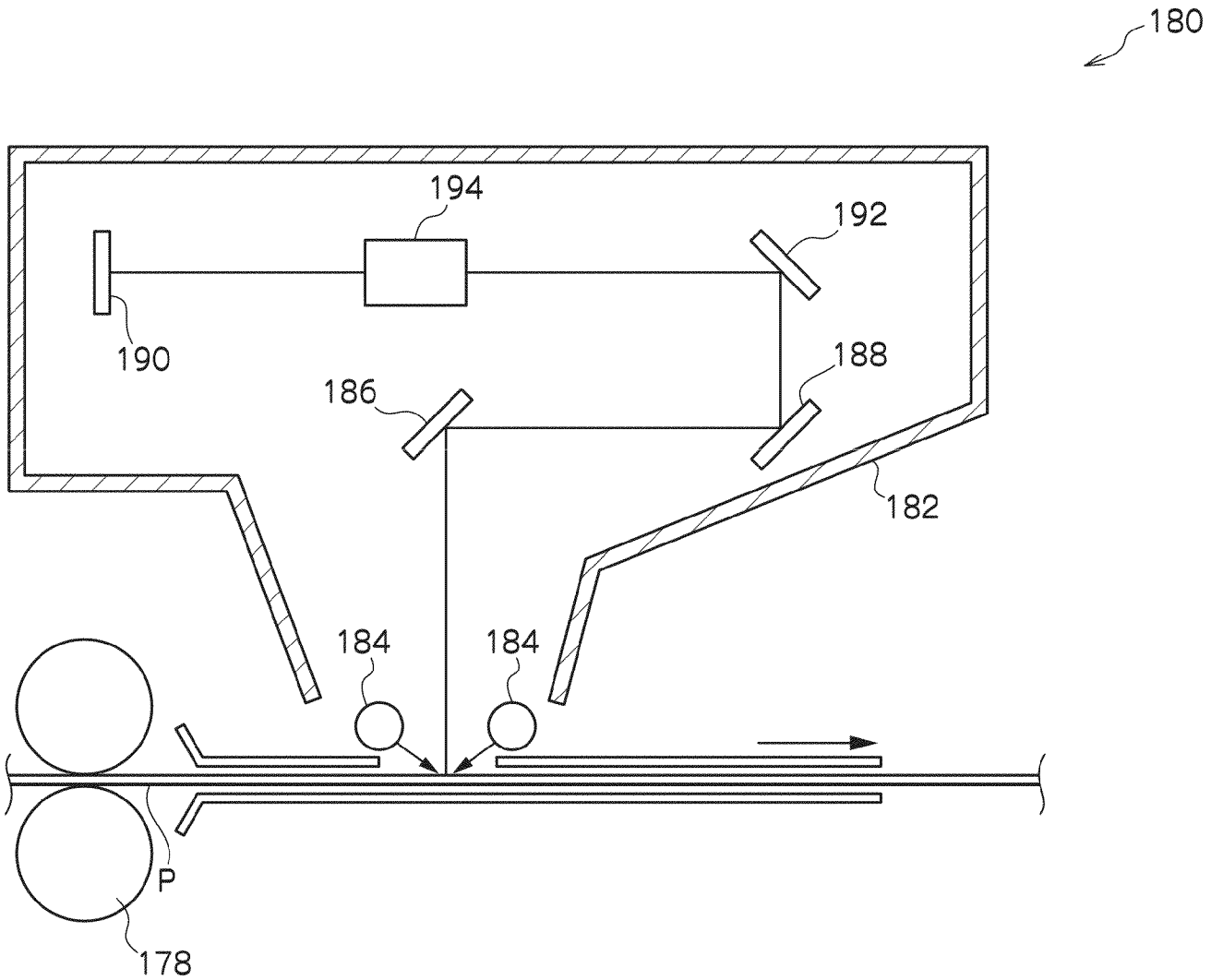
FIG. 11 is a configuration diagram illustrating an in-line sensor unit used in the image forming apparatus of the exemplary embodiment of the present invention.

As illustrated in FIG. 11, two light-emitting members 184 are provided in a chassis 182 of the in-line sensor unit 180 in order to irradiate the sheet member P conveyed by the conveying roller 178 with light. A mirror 186 and a mirror 188 are also provided in the chassis 182. The mirror 186 reflects the light which is emitted from the light-emitting member 184 and upwardly reflected by the sheet member P toward the horizontal direction. The mirror 188 reflects upwardly the light horizontally reflected by the mirror 186. A mirror 192 is also provided in the chassis 182, and the mirror 192 folds the light upwardly reflected by the mirror 188 toward a CCD type optical sensor 190. A collective lens 194 is provided between the mirror 192 and an optical sensor 190, and the collective lens 194 collects the reflected light onto the optical sensor 190.

Therefore, the optical sensor 190 may detect the toner density defect, the image defect, and the image position defect and the like.

(Inverting Unit)

As illustrated in FIG. 1, a discharge roller 198 is provided on the downstream side of the in-line sensor unit 180. The discharge roller 198 discharges the sheet member P of which the image is formed in one side to a discharge tray 196 attached to a side surface of the second chassis 10B.

In cases where the images are formed in both the side of the sheet member P, the sheet member P delivered from (passing by) the in-line sensor unit 180 is conveyed to an inverting unit 200 provided on the downstream side of the in-line sensor unit 180.

Particularly, a switching member (not illustrated) guides the sheet member P to an inverting path 202 provided in the inverting unit 200.

A branch passage 202A, a sheet conveying passage 202B, and an inverting passage 202C are provided in the inverting path 202. The branch passage 202A is branched from the conveying path 60. The sheet conveying passage 202B conveys the sheet member P conveyed along the branch passage 202A toward the side of the first chassis 10A. The inverting passage 202C turns back the sheet member P conveyed along the sheet conveying passage 202B toward the opposite direction to turn the sheet member P over, that is, performs switchback conveyance to turn the sheet member P over.

By this configuration, the sheet member P switchback-conveyed by the inverting passage 202C is conveyed toward the first chassis 10A, the sheet member P enters the conveying path 60 provided above the sheet feeding cassette 48, and the sheet member P is delivered to the transfer point T again.

(Power Unit)

A power unit 210 that takes in an alternating current from the outside will be described below.

Figure 12:
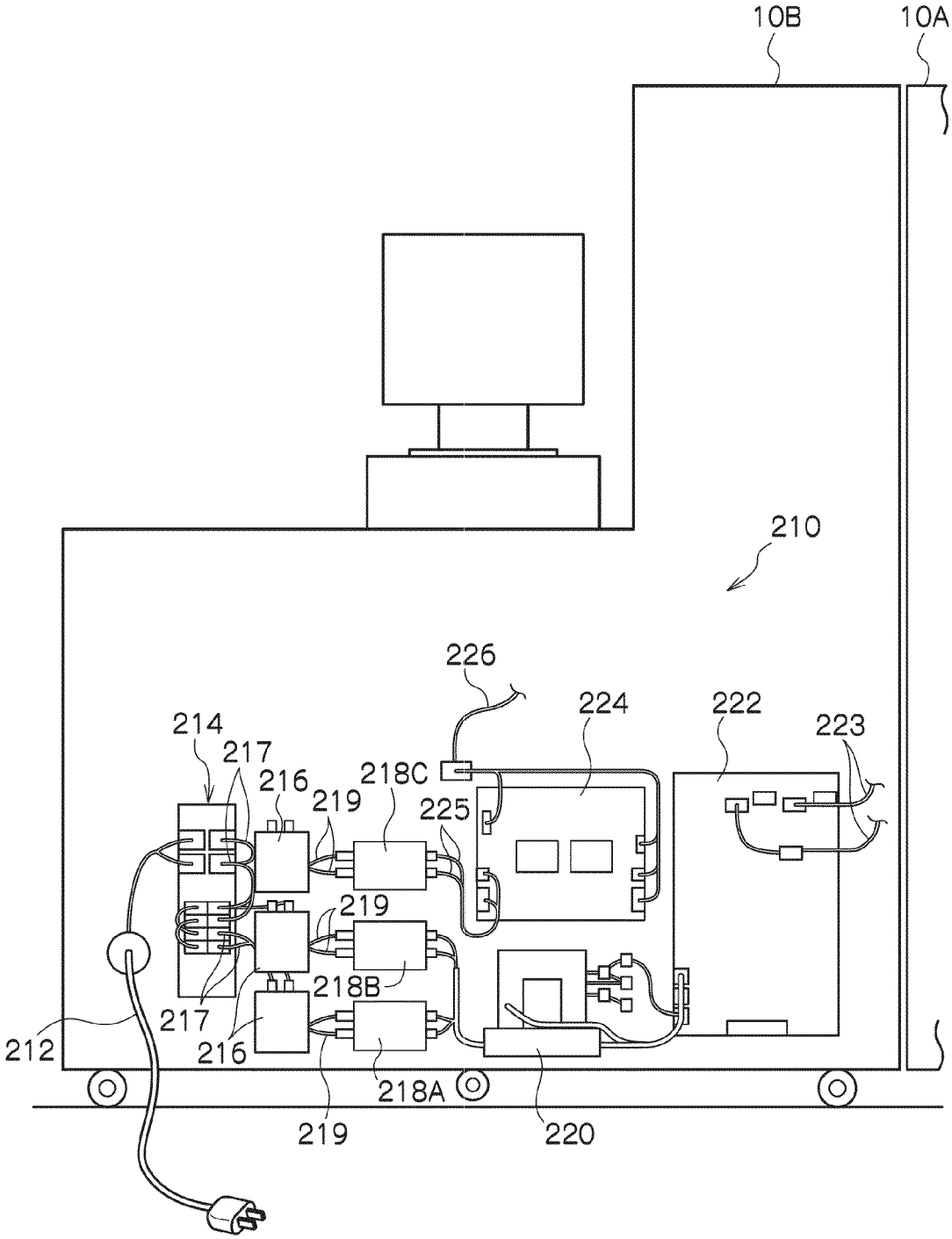
FIG. 12 is a configuration diagram illustrating a power unit used in the image forming apparatus of the exemplary embodiment of the present invention.

As illustrated in FIG. 12, the power unit 210 is provided in the back surface (back side) of the second chassis 10B. An input power cord 212 is provided in the power unit 210 in order to take in the alternating current from the outside. One end of a distributor 214 that distributes the alternating current is connected to the input power cord 212, and the other end of the distributor 214 is connected through a wiring cord 217 to one end of the circuit breaker 216 that shuts off overcurrent.

The other end of the circuit breaker 216 is connected through a wiring cord 219 to one end of each of noise filters 218A, 218B, and 218C that cut a noise of the alternating current. The other end of each of the noise filters 218A and 218B is connected to one end of a control board 222 for the fixing unit 82(see FIG. 1) through a transformer 220 that boosts or lowers the voltage.

The other end of the noise filter 218C is connected through a wiring cord 225 to one end of a control board 224 for a constant-voltage power supply. The other end of the control board 224 is connected to the control board 222 for the fixing unit 82 (see FIG. 1) and through a wiring cord 226 to a power supply unit 230 (see FIG. 1) that converts the alternating current into a direct current.

The other end of the control board 222 is connected to the fixing unit 82 (see FIG. 1) through a wiring cord 223 such that the alternating current is supplied through the control board 222 to the fixing unit 82 in which a large output is required.

On the other hand, as illustrated in FIG. 1, a power supply unit 230 connected to a control board 224 through a wiring cord 226 is disposed between the fixing unit 82 and the image signal processing section 13 in the second chassis 10B. The direct current converted by the power supply unit 230 is supplied to other units (such as the image forming unit 16) except for the fixing unit 82.

(Operation)

An image forming process of the image forming apparatus 10 will be described below.

As illustrated in FIG. 12, the alternating current is supplied from the outside through the input power cord 212 to the power unit 210 provided in the back surface of the second chassis 10B, supplied through the control board 222 to the fixing unit 82 provided in the second chassis 10B, and supplied through the control board 224 to the power supply unit 23 provided in the second chassis 10B.

As illustrated in FIG. 1, the alternating current supplied to the power supply unit 23 is converted into the direct current, and the direct current is supplied to each unit, thereby activating each unit.

The image signal processing section 13 in the activated state performs the image processing to the image data, and the image data is converted into color gradation data and supplied to each exposure unit 40. Each exposure unit 40 emits the exposure light L according to color gradation data to perform scanning exposure to the photoreceptor 18 charged by the scorotron charger 20, thereby forming the latent image (the electrostatic latent image).

As illustrated in FIG. 2, the developing devices 22 develop the electrostatic latent images formed on the photosensitive bodies 18, and the electrostatic latent images are visualized as the first special color (V), second special color (W), yellow (Y), magenta (M), cyan (C), and black (K) toner images (developer images).

As illustrated in FIG. 1, the first special color (V), second special color (W), yellow (Y), magenta (M), cyan (C), and black (K) toner images sequentially formed on the photosensitive bodies 18 of the image forming units 16V, 16W, 16Y, 16M, 16C, and 16K are multiply transferred onto the intermediate transfer belt 34 by the six primary transfer rollers 36V, 36W, 36Y, 36M, 36C, and 36K.

The first special color (V), second special color (W), yellow (Y), magenta (M), cyan (C), and black (K) toner images multiply transferred onto the intermediate transfer belt 34 are secondary-transferred onto the sheet member P conveyed from the sheet feeding cassette 48 by the secondary transfer roller 62. The vacuum conveying device 70 conveys the sheet member P to which the toner images are transferred toward the fixing unit 82 provided in the second chassis 10B.

The fixing unit 82 heats and pressurizes the sheet member P to fix the first special color (V), second special color (W), yellow (Y), magenta (M), cyan (C), and black (K) toner images onto the sheet member P. The sheet member P to which the toner images are fixed is cooled by passing by the cooling unit 110. Then the sheet member P is delivered to the decurl treatment unit 140 to correct the curl generated in the sheet member P.

The in-line sensor unit 180 detects the image defect of the sheet member P in which the curl is corrected, and the discharge roller 198 discharges the sheet member P to the discharge tray 196.

On the other hand, in cases where the image is formed in the non-image surface in which the image is not formed (in the case of the duplex printing), after the sheet member P passes by the in-line sensor unit 180, the switching member (not illustrated) delivers the sheet member P to the inverting unit 200. The sheet member P delivered to the inverting unit 200 is inverted by passing through the inverting path 202, the sheet member P is delivered to the conveying path 60 provided above the sheet feeding cassette 48, and the toner images are formed in the back surface by the above-described procedure.

As described above, the cooling unit 110 is provided between the fixing unit 82 and the in-line sensor unit 180 in order to cool the sheet member P. That is, because the heat is drawn from the sheet member P delivered to the in-line sensor unit 180, a change in optical path length between the optical sensor 190 and a reflection region of the sheet member P where the light emitted from the light-emitting member 184 is reflected, which is caused by increase of a temperature at the in-line sensor unit 180, is suppressed.

The decurl treatment unit 140 is provided between the fixing unit 82 and the in-line sensor unit 180 in order to correct the curl of the sheet member P. That is, the flat sheet member P is delivered to the in-line sensor unit 180, a change in position of the reflection region of the sheet member P where the light emitted from the light-emitting member 184 is reflected is prevented and the change in optical path length between the reflection region and the optical sensor 190 is suppressed.

The suppression of the change in optical path length between the reflection region and the optical sensor 190 improves the detection accuracy when the in-line sensor unit 180 detects the toner density defect, image defect, and image position defect of the image formed in the sheet member P.

The decurl treatment unit 140 is provided on the downstream side of the cooling unit 110. For example, when the decurl treatment unit is provided on the upstream side of the cooling unit, the roller provided in the decurl treatment unit abuts partially on the sheet member P that is delivered from and heated by the fixing unit 82, and the roller draws the heat from the region where the roller abuts on the sheet member P, which may cause a problem in that the region differs from other regions in surface quality (such as glossiness). However, as described above, the decurl treatment unit 140 is provided on the downstream side of the cooling unit 110, thereby suppressing such the problem that the region where the roller abuts on the sheet member P differs from other regions in surface quality.

Although the specific exemplary embodiment is described in detail, the invention is not limited to the exemplary embodiment. It is understood for those skilled in the art that various modifications can be made without departing from the scope of the invention. For example, in the exemplary embodiment, the xerographic image forming apparatus is described only by way of example. In an inkjet image forming apparatus, the above-described layout of the exemplary embodiment may be provided on the downstream side of the heating device that dries ink ejected to the sheet member P using hot air.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a heating device that heats the image formed at the image forming unit, on the recording medium while recording medium is conveyed;

a detecting device that is provided on a downstream side of the heating device in a recording medium conveying direction and detects image density and an image defect of the recording medium; and a stabilizing device that is provided between the detecting device and the heating device and stabilizes physical changes in the recording medium, wherein the stabilizing device is configured by a cooling device that cools the recording medium and a curl correcting device that corrects curl generated in the recording medium, and the curl correcting device is provided on a downstream side of the cooling device, the cooling device having higher cooling effect in an upstream side of the curl correcting device than in a downstream side of the curl correcting device.

2. The image forming apparatus of claim 1, wherein the detecting device irradiates the image formed on the recording medium with light and receives the light reflected from the image, to detect the image density and image defect of the recording medium.

3. The image forming apparatus of claim 1, comprising:

a first chassis that is provided on one side in a horizontal direction and includes the image forming unit, the image forming unit forming the image on the conveyed recording medium; and a second chassis that is provided on another side in the horizontal direction, the recording medium being conveyed from the first chassis to the second chassis, wherein the heating device, the stabilizing device, and the detecting device are provided in the second chassis.

4. An image forming apparatus comprising:

an image forming unit that forms an image on a recording medium;

a heating device that heats the image formed at the image forming unit, on the recording medium while recording medium is conveyed;

a detecting device that is provided on a downstream side of the heating device in a recording medium conveying direction and detects image density and an image defect of the recording medium; and a stabilizing device that is provided between the detecting device and the heating device and stabilizes physical changes in the recording medium, wherein the stabilizing device is configured by a cooling device that cools the recording medium and a curl correcting device that corrects curl generated in the recording medium, and the curl correcting device is provided on a downstream side of the cooling device.

* * * * *